US006183263B1

(12) United States Patent
Tacchi et al.

(10) Patent No.: US 6,183,263 B1
(45) Date of Patent: Feb. 6, 2001

(54) ARTICULATE ELECTRIC CONNECTOR

(76) Inventors: Alberto Miguel Tacchi; Carlos Miguel Benzaquen; Guillermo Enrique Malanca, all of San Martin 686, 7°piso of. 72°, 1004 Capital Federal (AR)

( * ) Notice: Under 35 U.S.C. 154(b), the term of this patent shall be extended for 0 days.

(21) Appl. No.: 09/144,640

(22) Filed: Aug. 31, 1998

(51) Int. Cl.[7] ..... H01R 39/00
(52) U.S. Cl. ..... 439/8; 439/17
(58) Field of Search ..... 439/8, 6, 13, 17, 439/18, 19, 23, 29; 174/86

(56) References Cited

U.S. PATENT DOCUMENTS 3,328,741 * 6/1967 Brown ..... 439/8
4,978,306 * 12/1990 Robb ..... 439/8
5,915,974 * 6/1999 Carter ..... 439/8

* cited by examiner

*Primary Examiner*—Paula Bradley
*Assistant Examiner*—Alexander Gilman
(74) *Attorney, Agent, or Firm*—Pendorf & Cutliff

(57) ABSTRACT

The present invention is an articulate electric connector that is mounted on the handle of a mobile electric apparatus that has first and second terminal of electric connection. The invention has a universal joint that is formed by a spherical body contained within an articulation cavity. Included is an assembly support that has walls that define the articulation cavity and an inlet mouth that allows communication from the exterior with the articulation cavity. The entrance of the cable in the spherical body has conductors, which are connected to two respective mobile contacts that are fixed to the spherical body. Within the cavity are two fixed contacts that communicate with the mobile contacts. The movement of the spherical body is limited by the collisions of the inlet nozzle with the borders of the inlet mouth.

8 Claims, 3 Drawing Sheets

16
12
16
9'
5
2
14
13
b
11
1
3
c
a
4
6
8
9
4'
d
7
+
-

16
b
9
2
8
14
14'
13
c
5
1
11
12
16
3
4''
4'
4
d
7
6
8
a
1'
-
+

ARTICULATE ELECTRIC CONNECTOR

BACKGROUND OF THE INVENTION

The present model of utility consists on an articulate electric connector that allows to avoid the damages, disconnections and short circuits originated at the entrance end from the cables to the mobile electric apparatuses.

FIELD OF THE INVENTION

As it is known, there are numerous mobile and portable electric apparatuses that work being connected to the net of electric feeding. Such it is the case of apparatuses like the irons, portable drillers, electric welders, vacuum cleaners, etc.

For they have cables, the sufficiently long ones as so that the operator can use them appropriately, for without the long cables the connection to the socket would become uncoupled.

Nevertheless that the feeding cable has an appropriate longitude, it doesn't solve another serious inconvenience that is presented in this type of apparatus and such that at the end of the feeding cable that enters to the apparatus is subjected to permanent bending and tugs. For that reason that is one of the areas where first the cable deteriorates first. This deterioration is translated in such flaws as the cut of one or of both conductors inside the sheath of the cable, as a consequence of that which the apparatus stops to work or it makes it intermittently.

Other flaws that they take place that they have the same origin and that they are more dangerous than the previous one, they are the peelings in the sheath through which the conductors appear, with the rising danger of electrocution of the operator, or the flaws of internal insulation of the cable that give origin to a short circuit when both conductors are played.

To avoid these problems, traditionally it is appealed to such tubula protection head as sheaths that, subject to the frame of the apparatus in the area of entrance of the cable for the one that are threaded, absorb the twists and tugs pulls partially. However, the useful life of these sheaths is almost always smaller than that of the original apparatus, reason for which you arrives to a moment in that the cable is exposed to the mentioned risks.

A form of improving the functionality of these sheaths is that known sheaths conforming to a reinforced base and provided with a couple of articulations that gives it a mobility predetermined to the cable. This solution is more effective than that of the simple traditional sheath, although it presents its own limitations.

In the first place, if it is structured in a more rigid material, the articulate supports the tugs pulls well, but the intermediate tract cracks quicker. On the contrary, if a softer is used for, the sheath it will deteriorate in the articulations and when it finishes it is left anchored in the frame of the apparatus. In second place, this type of sheaths is articulate so that they move alternatingly, but always inside oneself plane for what the traverse tugs to the articulation plane end up breaking them.

All these problems are satisfactorily resolved by means of the present down articulate electric connector, because it has a universal joint composed of a spherical body and an articulation cavity conformed by an assembly support. On this spherical body and on the support they mount, respectively, a couple of contacts mobile sliding and a couple of contacts fixed sliding that allow the interconnection between the conductors of the cable and the terminals of connection of the apparatus.

The movements of the cable of the apparatus are accompanied by the operation of the universal joint. At the same time, these movements are limited by the stop of articulation composed by an entrance nozzle and the borders of the inlet mouth, so that the linking between the fixed contacts and the motives is permanent.

The final result is that the cable moves multidirectional accompanied according to two planes the movements of the operator, avoiding the mess and the strangulations of the cable, and without there are feeding interruptions to the terminals of the apparatus.

BRIEF DESCRIPTION OF THE DRAWINGS

For a better clarity and comprehension of the object of the invention, it is illustrated with various figures, in which it has been represented in some of the preferred embodiments; all as an illustrative, not limiting example, being.

In the different figures, the same reference numbers indicate same or corresponding parts, and the groups of several elements have been pointed out with letters.

Figure 2:
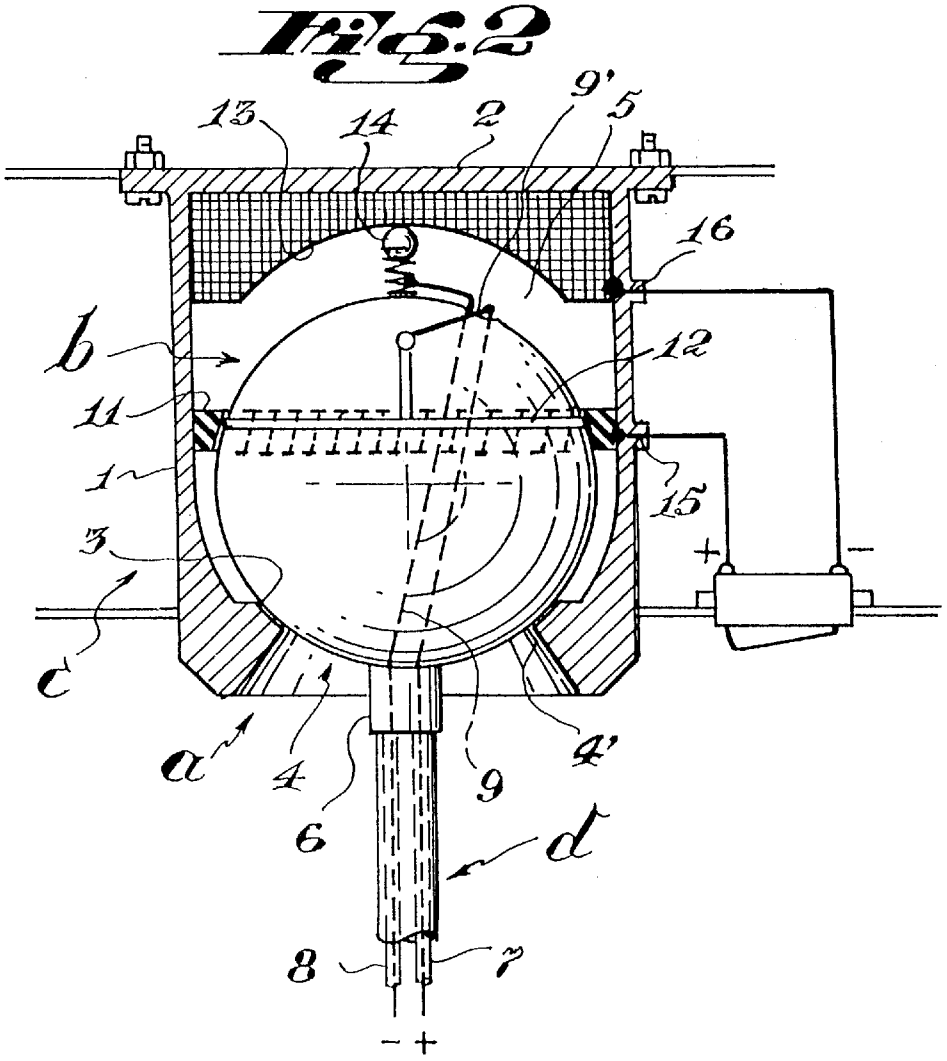
FIG. 2 is a longitudinal cut of the connector in a form of embodiment in which the assembly support has a collapsible base by way of cover of inspection of the articulation cavity.
Figure 1:
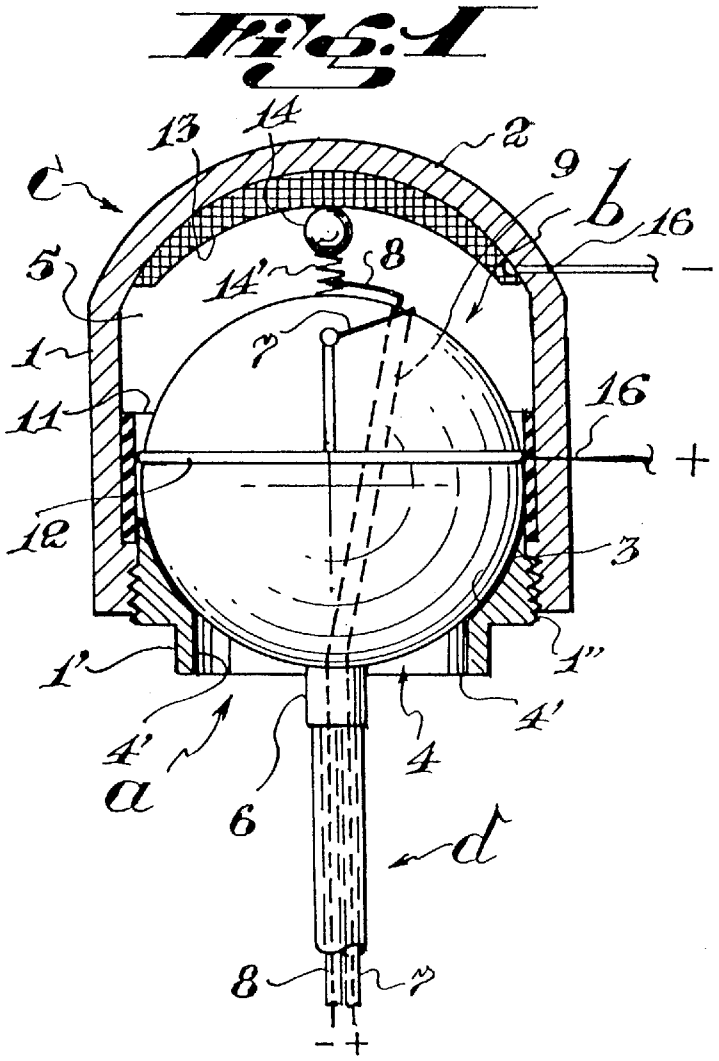
FIG. 1 is longitudinal cut of the connector in which one can appreciate the disposition of the different parts that you/they constitute it. With lines discontinuous the conduit that crosses the spherical body leave.
Figure 3:
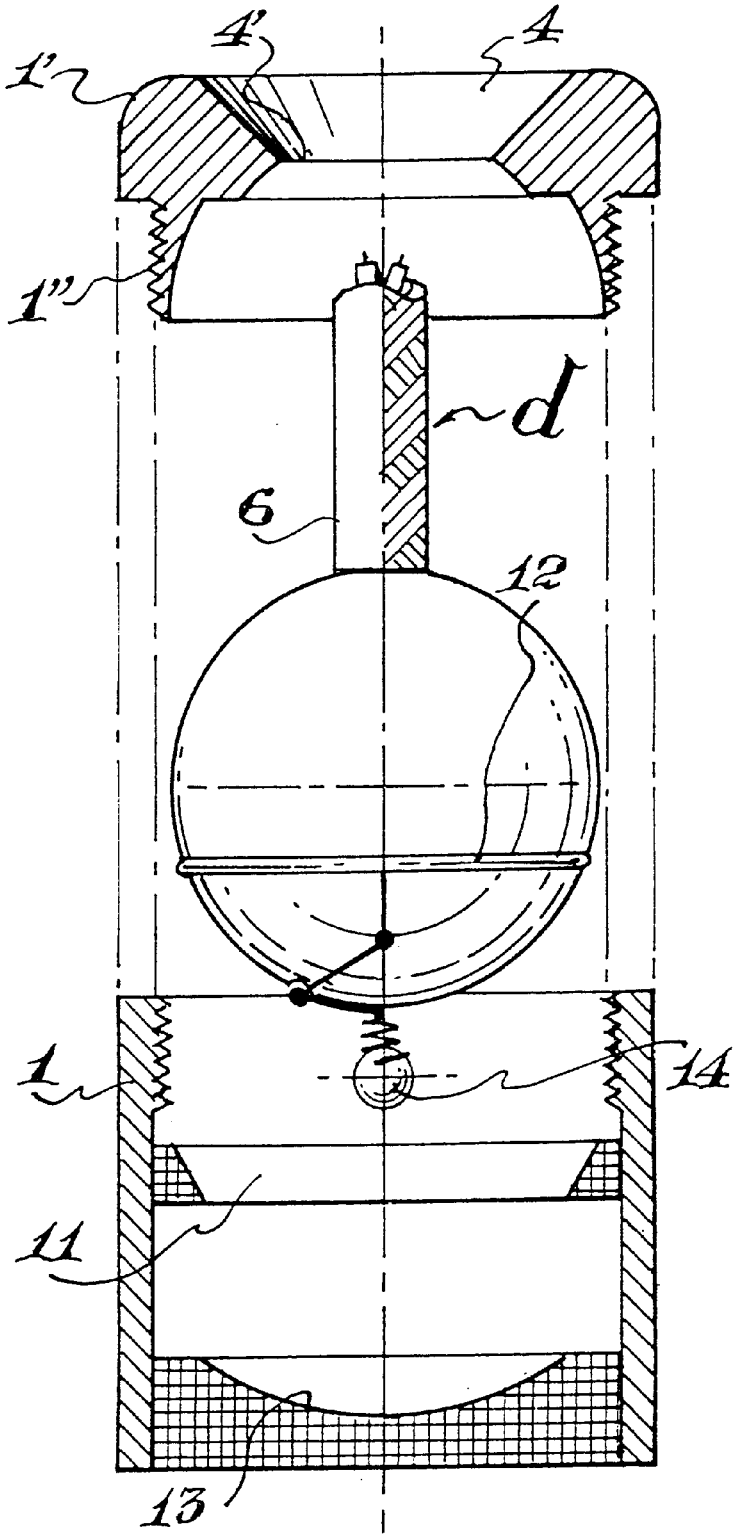
FIG. 3 is a longitudinal cut of a division of the connector in which the conformation of the component parts is appreciated.
Figure 4:
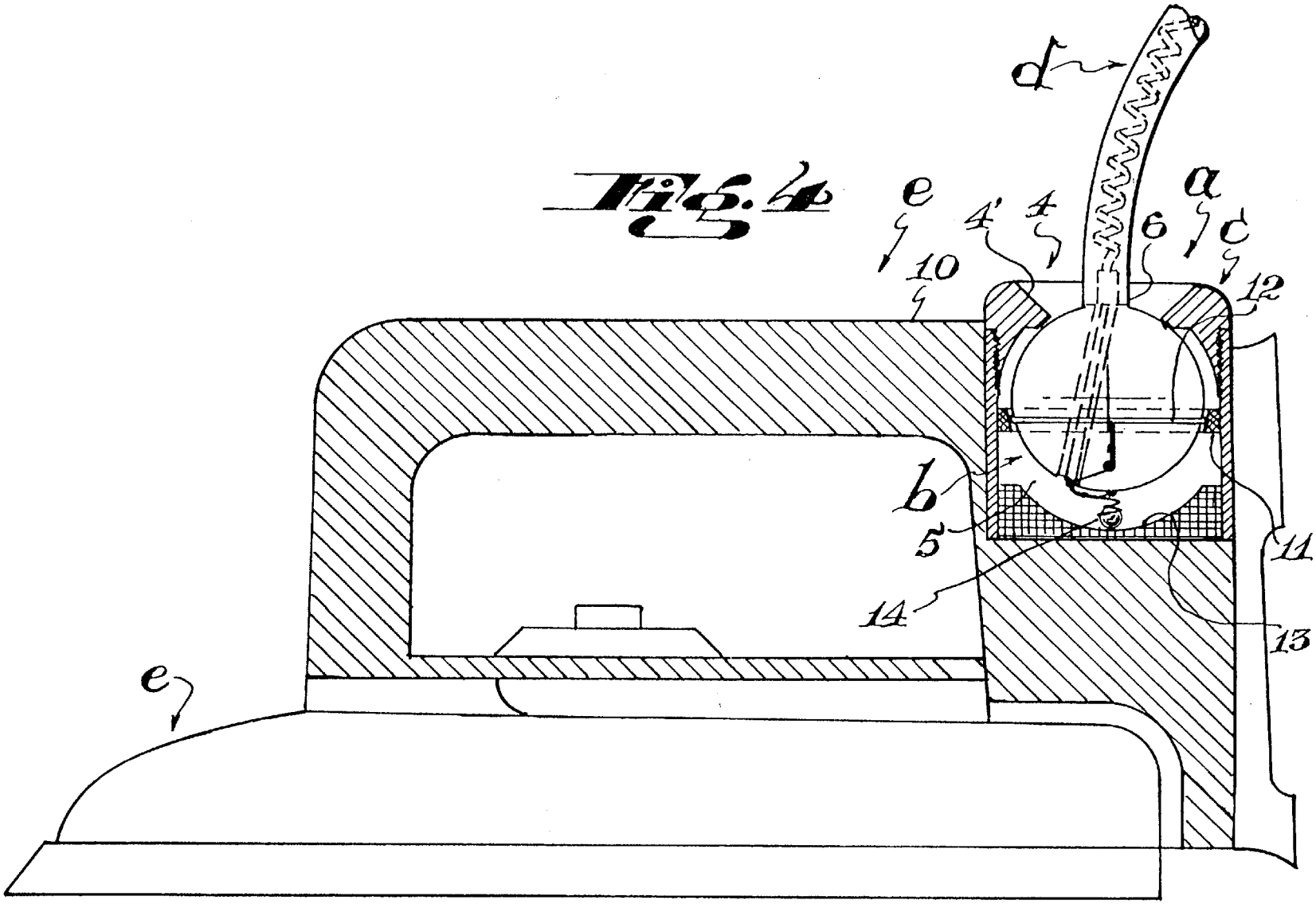
FIG. 4 is a longitudinal cut of the connector that appears mounted on the frame of a mobile electric apparatus, in this case an iron.

LIST OF THE MAIN REFERENCES:

(a) universal joint.
(b) spherical body.
(c) assembly support.
(d) electric power cable.
(e) mobile electric apparatus.
(1) main body of the assembly support (c).
(1') removable base of the assembly support (c).
(1") thread
(2) bottom of the main body (1).
(3) seat of articulate retention.
(4) inlet mouth.
(4') border of the inlet mouth (4).
(5) cavity of articulation of the support (c).
(6) inlet nozzle of cable (d) to the spherical body (b).
(7) first conductor of the cable (d).
(8) second conductor of the cable (d).
(9) conduit of the spherical body (b).
(9') exit of the conduit (9).
(10) frame of the mobile electric apparatus (e).
(11) fixed annular contact.
(12) mobile annular contact.
(13) contact of fixed bottom.
(14) mobile polar contact.
(14') spring of the mobile polar contact (14).
(15) first terminal of electric connection.
(16) second terminal of electric connection.

SUMMARY OF THE INVENTION

To the specified ends, the articulate electric connector, is mounted on the frame (10) of a mobile electric apparatus (and) having first (15) and second (16) terminals of electric connection, it is dedicated to the admission in this apparatus (and) of a cable (d) with at least a first (7) and second (8) conductors; this electric connector is characterized because it has the following:

a) universal joint (to) composed by a spherical body (b) and an articulation cavity (5) that contains it;

b) an assembly support (c) that, inwardly, conforms to this articulation cavity (5) communicating with the exterior through an inlet mouth (4);

c) in this spherical body (b) an entrance (6) of this cable (d) whose conductors (7)(8) are connected to two respective mobile contacts slidingly (12)(14) fixed to this spherical body (b);

d) inside this cavity (5) of this assembly support (c), two fixed contacts sliding (11)(13) on those that permanently mobile support this contacts mobile (12)(14); and e) the collisions or stop of articulation are controlled by this entrance (6) and the borders (4') of this inlet mouth (4).

DETAILED DESCRIPTION OF THE INVENTION

In general terms, the model present of utility is a consistent articulate electric connector in a universal joint (to) composed by a spherical body (b) and an articulation cavity (5) conformed for an assembly support (c)—on those that mount a couple of contacts mobile sliding (12)(14) and a couple of contacts fixed sliding (11)(13), respectively, having this spherical body (b) with a stop of articulation defined by the borders (4') of an inlet mouth (4) and for an entrance nozzle (6) of a feeding cable (d).

More particularly, it is a connector that, is dedicated to their assembly on the frame (10) of a mobile electric apparatus (and) just as an iron, a portable drill press, a welder, etc., it serves as admission in this apparatus (and) of a cable (d) with a couple of conductors (7)(8) for feeding electricity.

This electric connector conforms a universal joint (to) composed by a spherical body (b) and an articulation cavity (5) that contains it the electric connector.

The articulation cavity (5) is defined by the walls of a assembly support (c) that communicates to this cavity (5) with the exterior through an inlet mouth (4). In different realization forms, the mentioned assembly support (c) can be constituted by a single piece or to be compound for a main body (1) and a removable base (1') interconnected by means of a thread (1"). This removable base (1') is a means that is removed and put aside to allow inspection of this cavity of articulation (5).

On the other hand, the spherical body (b) has an entrance at the inlet nozzle (6) for the one that enters the cable (d) of electric feeding. This entrance (6) consists of a collar, or small opening that, in a favorite form of realization, is constituted by a tubular body. However they are equally capable other means such equivalent as an external tubular reinforcement of the walls of the cable (d) in the entrance area to the spherical body (b).

This entrance nozzle (6) composes, together with the borders (4') of the inlet mouth (4) and the movement of the spherical body (b) is limited by the collisions of the inlet nozzle (6) with the borders of the inlet mouth (4) of the assembly support. .

Starting from the-mentioned inlet nozzle (6), the spherical body (b) is crossed by a conduit (9) that finishes in an exit proximal (9') to the contacts mobile sliding (12)(14).

These contacts mobile sliding (12)(14) they understand a mobile extreme contact (14) and a contact ring motive (12). The mobile extreme contact (14) includes a contact ball with a spring (14') of compression. Both contacts mobile sliding (12)(14) are supported permanently against respective contacts fixed sliding (11)(13) provided by the assembly support (c).

One of the contacts fixed sliding is the contact of fixed bottom (13) consistent in a piece that, connected to the second terminal (16) of connection, it forms a concave surface against, which is usually tightened by their spring (14'), the mobile extreme contact (14) that is projected from the spherical body (b).

The other contact fixed sliding is the fixed ring contact (11) composed by a ring piece that, connected to the first terminal (15) of connection, it is fixed to the assembly support (c) where it is played permanently by the mobile contact ring (12) fixed to the surface of the mentioned pherical body (b).

On the other hand, inside the articulation cavity (5), in the internal area adjacent to the inlet mouth (4), the walls of the assembly support (c) forms a seat of articulate retention (3) for the spherical body (b).

This last one (b) is usually tightened against that seat of articulate retention (3) for half the tension of a half elastic on that, in the present realization form, it consists on the same spring (14') that composes the mobile extreme contact (14).

The group works in the following way:

When being used the mobile electric apparatus (and), constant movements of the cable of electric feeding take place (d) and includes both conductors (7)(8).

These movements of the cable (d) are accompanied by the operation of the universal joint (to), causing the rotation of the spherical body (b) inside the articulation cavity (5) formed by the assembly support (c). This way the tugs of the mentioned cable for feed electricity are avoided (d)and moves amply although without interrupting it the electricity supply to the mobile electric apparatus (and).

This happens because the articulate movements of the spherical body (b) are limited by the one it collides of articulation composed by the inlet nozzle of (6) and the borders (4') of the inlet mouth (4).

This limitation of the articulation be longs together with the slip career that both mobile contacts (12)(14) have on its respective fixed contacts (11)(13), so that the electric contact takes place permanently.

As a result, the cable moves multidirectional according to two planes, impeding from getting entangled, twist excessively or cut.

It is certain that being the model present of utility is put into practice, modifications concerning certain details in construction and shape, may be introduced without this implying drawing apart from the fundamental principles that are clearly substantiated in the clauses of the following claims:

Having thus specially described and determined the nature of the present invention, and how it can be carried out, it is declared as of exclusive right and property:

What is claimed is:

1. An articulate electric connector mounted on the frame of a mobile electric apparatus that has a first terminal and a second terminal of electric connection and includes a cable with at least a first conductor and a second conductor, which comprises;

a universal joint having a spherical body and an articulation cavity in receipt of the spherical body, an assembly support having walls for defining the articulation cavity and an inlet mouth that allows communication from the exterior with the articulation cavity, the spherical body having an entrance for receipt of the cable whose conductors are connected to two respective mobile contacts that are fixed to the spherical body, the articulation cavity of the assembly support having two fixed contacts that are in permanent contact with the respective mobile contacts of the spherical body, and wherein the movement of the spherical body is limited by the collisions of the inlet nozzle with the borders of the inlet mouth.

2. The articulate electric connector as set out in claim 1, wherein the assembly support having a seat of articulation retention for the spherical body to rest against, and the spherical body is usually tightened there against by a half elastic one.

3. The articulate electric connector as set out in claim 1, wherein the assembly support has a removable base that provides cover for the cavity of articulation and allows inspection of the cavity of articulation.

4. The articulate electric connector as set out in claim 1, wherein a conduit of the spherical body crosses by the spherical body and intercommunicates with the inlet nozzle of the cable and a exit of the conduit and proximate to both mobile contacts.

5. The articulate electric connector as set out in claim 1, wherein one of the fixed contacts being formed of a piece that is connected to one of the terminals of electric connection, and forms a concave surface against one of the mobile contacts projecting from the spherical body is tightened adjacent thereto; while one other of the fixed contacts being a ring piece that connects with the other of the terminal electric connections, and is fixed to the assembly support, the ring piece is in permanent communication with the other mobile contact fixedly attached to a surface of the spherical body.

6. The articulate electric connector as set out in claim 5, wherein the half elastic one of one of the mobile contacts, constitutes a half tension of the spherical body against the seat of articulate retention.

7. The articulate electric connector as set out in claim 1, wherein the entrance of the cable to the spherical body is an inlet nozzle.

8. The articulate electric connector as set out in claim 7, wherein the inlet nozzle of the cable is formed by a tubular body to reinforce the walls of the cable in the contact area near the borders of the inlet mouth.

* * * * *